United States Patent [19]

Goubau

[11] 3,967,276

[45] June 29, 1976

[54] ANTENNA STRUCTURES HAVING REACTANCE AT FREE END

[75] Inventor: George E. J. Goubau, Eatontown, N.J.

[73] Assignee: Beam Guidance Inc., New York, N.Y.

[22] Filed: Jan. 9, 1975

[21] Appl. No.: 539,703

[52] U.S. Cl. ..... 343/752; 343/804; 343/828; 343/830

[51] Int. Cl.[2] ..... H01Q 9/36

[58] Field of Search ..... 343/795, 797, 798, 802, 343/830, 845, 899, 752, 804, 828

[56] References Cited

UNITED STATES PATENTS 2,558,145 6/1951 Mock ..... 343/802

FOREIGN PATENTS OR APPLICATIONS 869,650 3/1953 Germany ..... 343/802

220,059 6/1942 Switzerland ..... 343/845

*Primary Examiner*—Eli Lieberman

*Attorney, Agent, or Firm*—Theodore Hafner

[57] ABSTRACT

The invention relates to an antenna structure comprising a number of parallel conductors having dimensions and spacings which are small against operating wavelength, and positioned perpendicular to a conducting ground plane; the upper ends of the conductors are terminated by metal plates acting as capacitors against the ground plane, and interconnected by inductive elements, the lower ends of some of said conductors are electrically connected to said ground plane, while another one of these conductors is connected to a power source to impress a voltage between the lower end of said other conductor and said ground plane.

18 Claims, 12 Drawing Figures

ANTENNA STRUCTURES HAVING REACTANCE AT FREE END

The invention relates to antenna structures, especially of a broadband character effective in the radio frequency range, preferably HF, VHF, UHF and higher frequencies.

One of the objects of the invention is to reduce the physical dimensions of such antenna structures to a minimum, substantially without affecting their gain and other radiation characteristics and especially suited to be used in locations where little space is available, or a minimum of visibility is desired.

A more specific object of the inventions is to obtain large bandwidth to permit the antenna to be used effectively for a number of operating wavelengths, without substantially involving switching operations of antenna elements or circuit elements.

These and other objects of the invention will be more fully apparent from the drawings annexed herein which.

Figure 7:
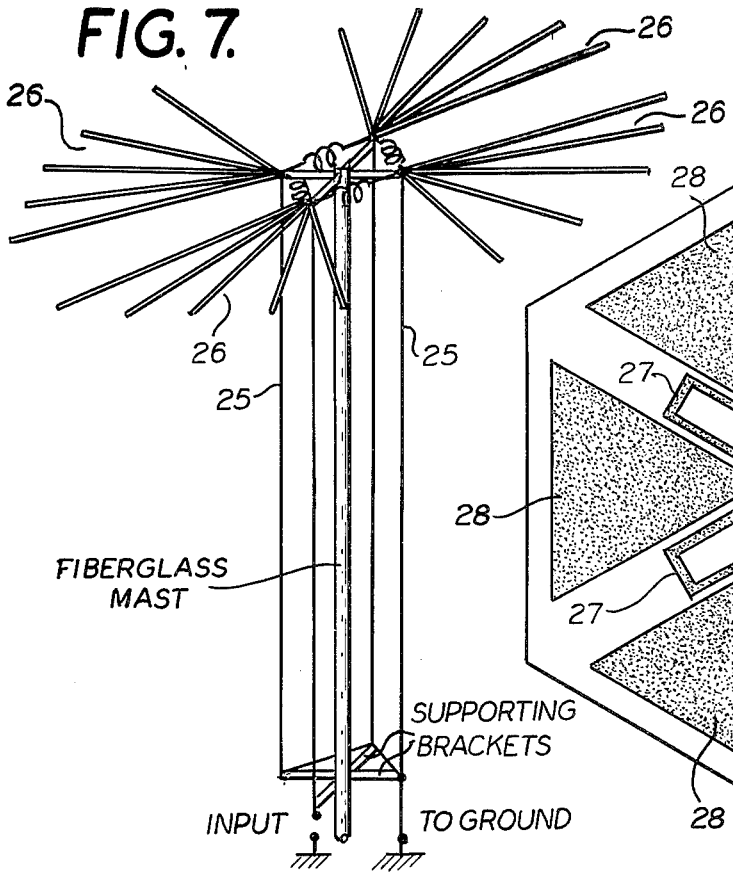

FIG. 7 indicates an embodiment of the invention operative in the HF range.

Figure 8:
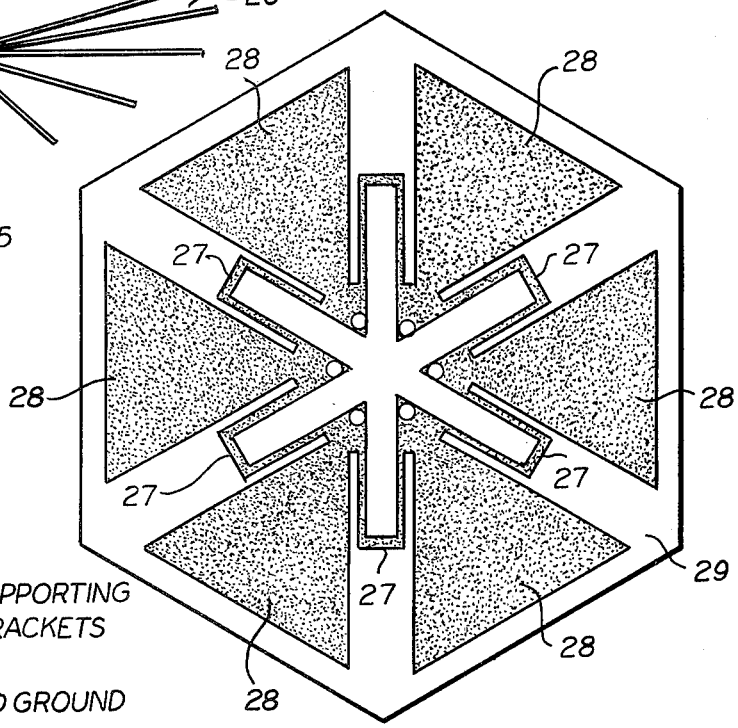
Figure 9:
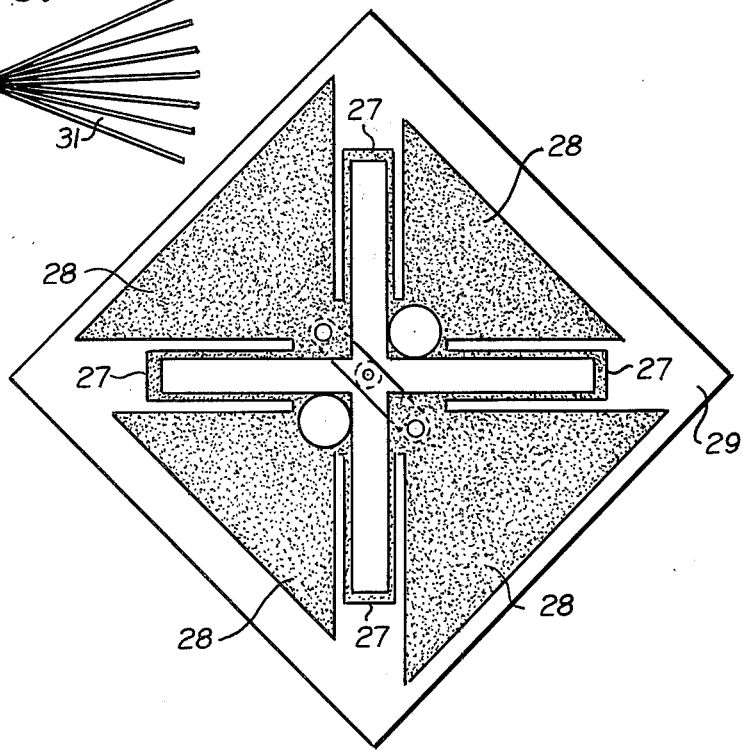

FIGS. 8 and 9 represent antenna structures embodying certain principles of the invention and operative in the UHF range.

Figure 10:
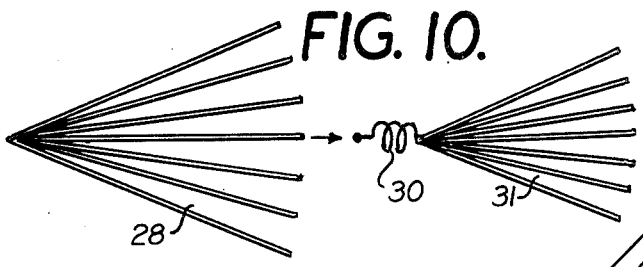

FIG. 10 represents a modification of the structure shown in FIG. 7.

Figure 1:
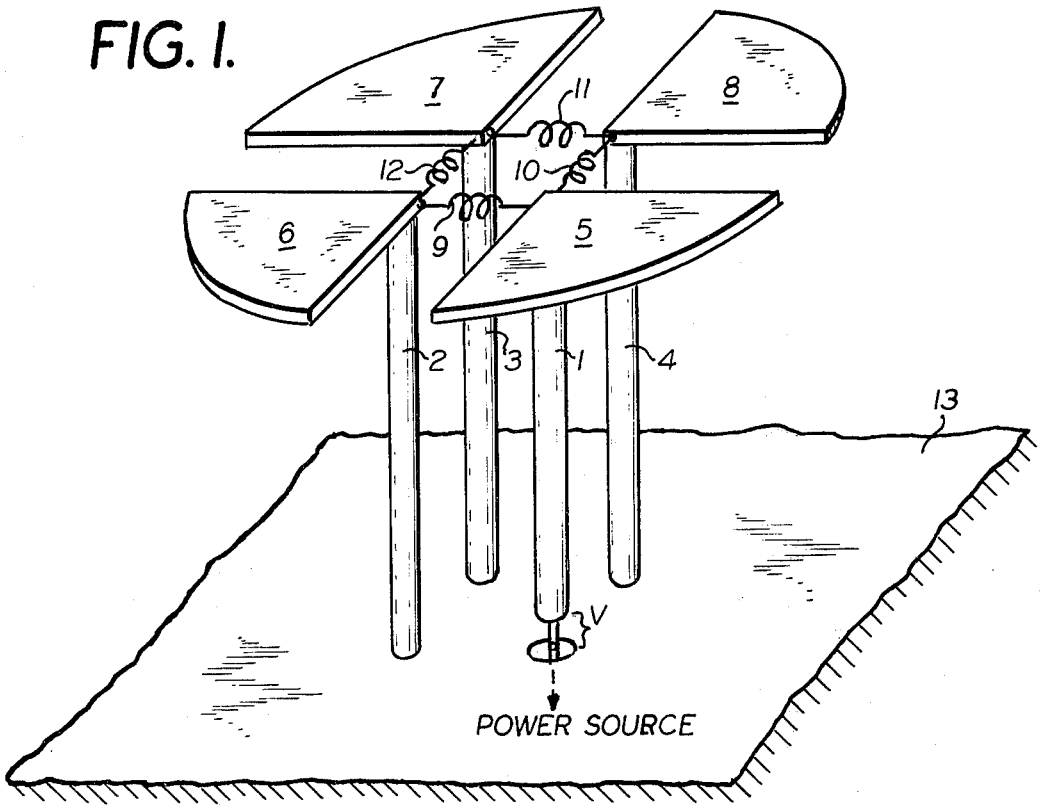
FIG. 1 illustrates diagrammatically and in perspective a structure embodying certain principles of the invention.
Figure 11:
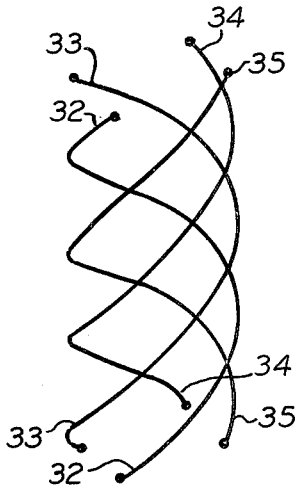

FIG. 11 shows another modification of FIG. 1 and

Figure 12:
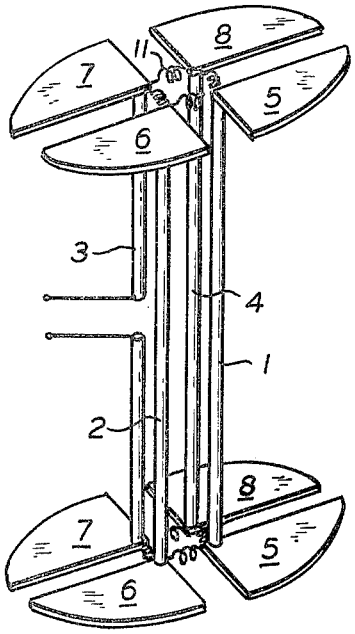

FIG. 12 illustrates schematically a dipole antenna according to the invention in the form of a modification or duplication of FIG. 1.

The embodiment of the invention shown in FIG. 1 comprises four cylindrical or elongated conductors 1, 2, 3 and 4 whose dimensions and spacings are small compared to the operating wavelength, and which are positioned perpendicular to a conducting ground plane 13. The upper ends of these conductors are terminated by metal plates 5, 6, 7 and 8 which act as capacitors against the ground plane 13, and are interconnected by inductive elements, 9, 10, 11 and 12. The lower ends of three of the cylindrical conductors (2, 3 and 4) are electrically connected to a power source which impresses a voltage V between the lower end of conductor 1 and the ground plane 13.

Figure 2:
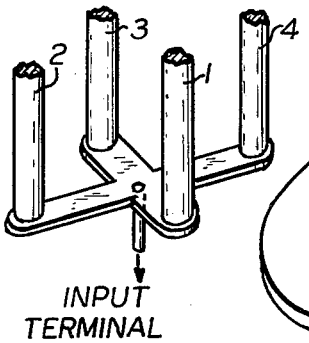
FIG. 2 shows a known type of conductor connections to convert the structure of FIG. 1 operationally into a conventional monopole as shown in FIG. 3.
Figure 3:
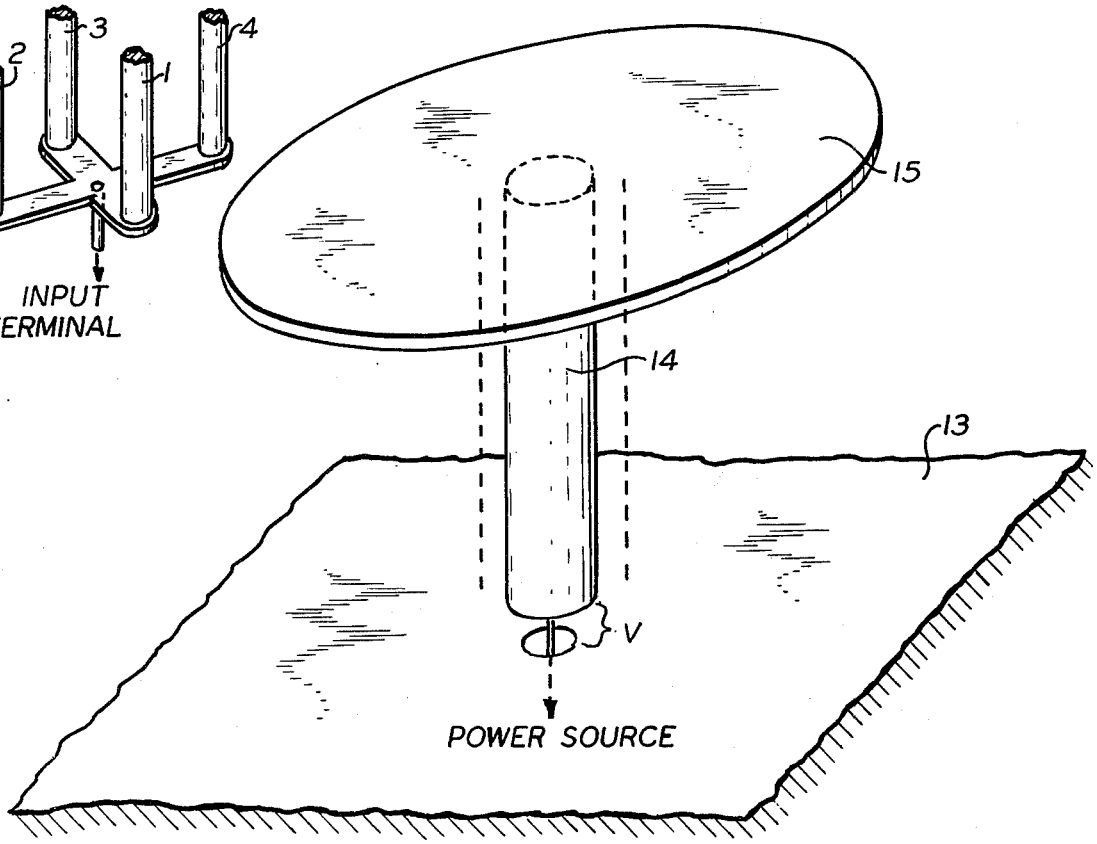

If the lower ends of all four cylindrical conductors were interconnected as shown in FIG. 2 and connected to a common power source which produces the same voltage V between the lower ends of all the conductors and the ground plane, the antenna would operate as a conventional monopole antenna as shown in FIG. 3 consisting of a relatively thick cylindrical conductor 14 of the length of the conductors 1 to 4 and a top capacity which is equal to the sum of the capacities of the plates 5, 6, 7, 8. Since the 4 segments of the antenna FIG. 1 — each segment consisting of one cylindrical or elongated conductor and the top capacity connected thereto — have been assumed to be identical in dimensions and symmetrically arranged, the currents in the four conductors would be the same, and there would be no currents flowing in the inductive elements 9 to 12 which interconnect the segments. These elements would therefore have no effect on the electric properties of the antenna. The input impedance Z of the antenna with all the cylindrical conductors connected to the source would have a resistive component due to radiation of energy (radiation resistance R) of the approximate amount.

$$R = 10 \left(\frac{7\pi h}{\lambda}\right)^2 \text{ Ohms}$$

where $h$ is the "effective" height of the antenna and $\lambda$ the operating wavelength. For short monopole antennas with top capacity the effective height is practically equal to the physical height, i.e. the length of the cylindrical conductors.

If the segmented antenna is operated as shown in FIG. 1 where only one of the cylindrical conductors is connected to the source, while the other three are grounded, the inductive elements 9 to 12 come into play. They can be dimensioned so that the input impedance of the antenna becomes 16 times as large as in the case with all conductors connected to the source. This means, the radiation resistance is 16 times as large, and the effective height four times the physical height. As an example, if the physical height is 2.67 cm, and the wavelength 60 cm (frequency 5000 MHz), the effective height is 10.7 cm, and the radiation resistance is 50 Ohms. A monopole antenna of the type shown in FIG. 3, having the same physical height of 2.67 cm has a radiation resistance of only 3.1 Ohm, assuming the same operating frequency. Since monopole antennas are usually fed through 50 Ohm coaxial cable conventional monopole antennas of small physical height require impedance transformers which substantially reduce efficiency and bandwidth of these antennas. Sectional monopole antennas according to this invention do not need such transformers and are therefore more efficient.

This invention is not limited to antennas consisting of four segments as shown in FIG. 1. Similar antennas can be constructed with any number N of segments formed by N cylindrical conductors which are perpendicular to a conducting ground plane each of these conductors being terminated at the upper end by a capacitive plate, and interconnected with the other conductors by inductive elements. The lower ends of all but one conductor are electrically connected with the ground plane, the unconnected one forming the input terminal of the antenna. If all N segments are dimensionally identical and arranged symmetrically around an axis perpendicular to the ground plane, and if furthermore the interconnecting inductances are appropriately dimensioned, the effective height of such an antenna is N times the physical height, and the radiation resistance approximately $$R = 10\, N^2 \left(\frac{7\pi h}{\lambda}\right)$$

i.e. $N^2$ times the radiation resistance of a conventional monopole antenna of the kind of FIG. 3 having the same height. For instance an antenna consisting of six segments requires a height of only 1.8 cm to have a radiation resistance of 50 Ohms at 500 MHz.

The invention, moreover, shall not be limited to antennas which are composed of identical segments and identical interconnecting reactances. It is an important feature of this invention that by using non-uniform segments and/or interconnecting elements that specific performance characteristics can be obtained. In particular, it is possible to design antennas with very large bandwidths. Non-uniform segments can, however, produce deviations from the normal radiation characteristic, which is essentially that of a physical (Hertzian) dipole located on the surface of a metal wall and oriented perpendicular to the surface. The deviation is caused by a dipole moment $M_p$ due to the currents in the capacitor plates. This dipole moment has a direction parallel to the ground plane.

The auxiliary radiation by this dipole moment is negligible for antennas with uniform segments, but can be large if the capacitor plates differ substantially in size.

Figure 4:
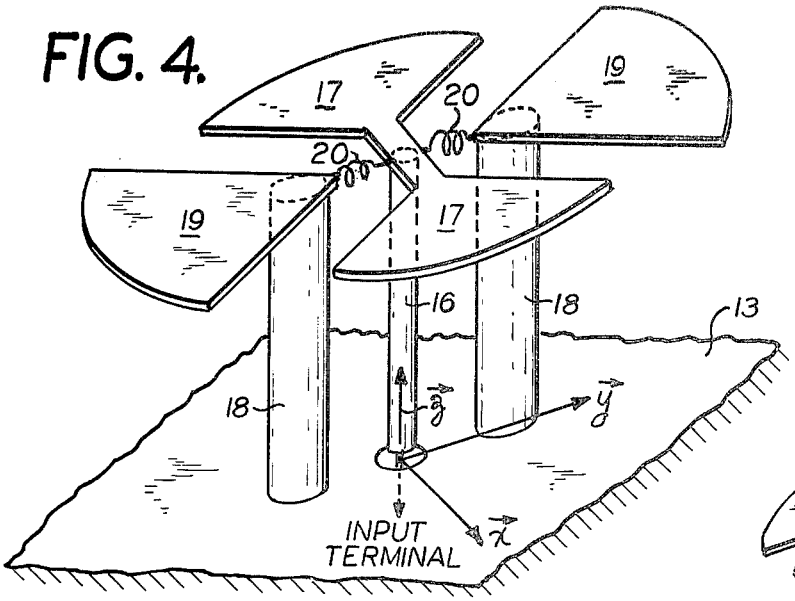
FIGS. 4 and 5 represent modifications of FIG. 1.
Figure 5:
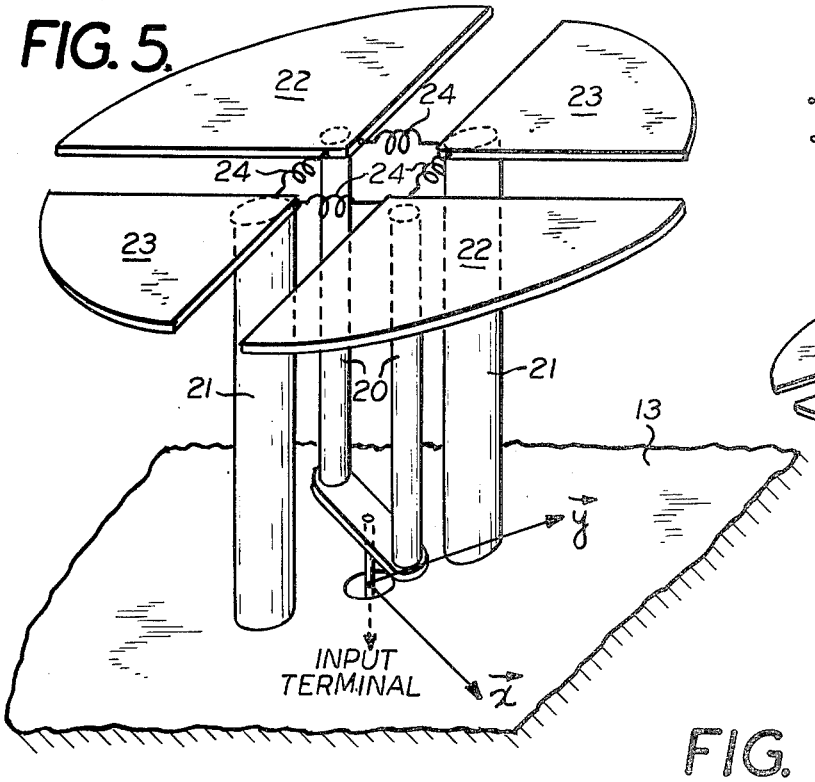

If simultaneous radiation by the horizontal dipole moment $M_p$ is undesirable, such radiation can be avoided by using antenna designs which have two planes of symmetry. Examples for such designs are shown in FIGS. 4 and 5. The planes of symmetry are the x, z and the y, z planes of the Cartesian coordinate systems indicated in the figures. This symmetry condition ensures that the auxiliary dipole moment $M_p$ does not exist. The antenna in FIG. 4 consists of three segments. The middle segment has a relatively thin conductor 16, which is connected to the input terminal. The other two segments which are identical have thick conductors 18, and are grounded. The capacitor plates of these segments have together a larger surface area than the capacitor plate 17 of the middle segment.

The antenna in FIG. 5 has two pairs of identical segments. One pair comprising the conductors 20 and the capacitor plates 22 is electrically interconnected at the lower ends of the conductors, and connected to the input terminal. The other pair of identical segments comprising conductors 21 and capacitor plates 23 has the lower ends connected to the ground plane. The diameter of the conductors 21 are substantially larger than those of conductors 20, and the capacitor plates 23 have smaller surface areas than the capacitor plates 22. The inductances 24 which interconnect the segments are alike.

Figure 6:
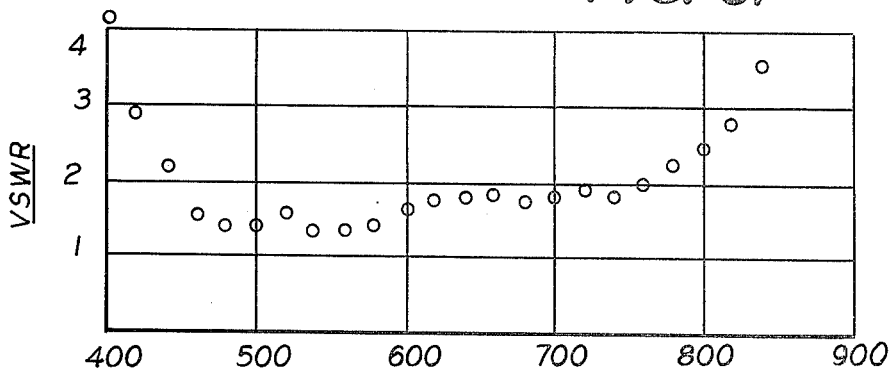
FIG. 6 shows a standing wave ratio characteristic of an antenna such as shown in FIG. 5.

FIG. 6 shows, as example, a measured standing wave ratio — versus frequency plot for an antenna of the type of FIG. 5, to demonstrate the wide band capabilities of such antennas.

The basic principle of this invention is not limited to the VHF and UHF range as the examples may suggest. But the engineering design will depend on the frequency range. FIG. 7 illustrates schematically a design of an HF antenna of the kind shown in FIG. 1. The cylindrical conductors are in this case wires 25 which are supported by a fiberglass mast. Of the four wires, three are electrically interconnected at the base of the mast, and grounded. The input terminals are formed by the lower end of the fourth wire and the ground system, which is assumed to be of conventional construction. The top capacitors 26 are formed by sets of radially directed wires.

In the UHF range the top capacitors and the interconnecting inductances may be produced in the form of metal films which are deposited on a dielectric base like printed circuits. FIGS. 8 and 9 show views of such antennas. FIG. 8 refers to an antenna with six identical segments. The interconnecting inductances are formed by loops 27 which together with the capacitors are "printed" on a dielectric sheet. FIG. 9 is a top view of an antenna of the kind shown in FIG. 5, but constructed using printed circuit techniques.

There are many variations which are within the scope of this invention, some of which are discussed in the following.

If it is desirable to reduce the physical dimensions of the top capacitors, the desired effective capacities can be produced by using smaller capacitor elements which are connected to the cylindrical conductors through appropriately dimensioned inductances as illustrated in FIG. 10. The left-hand side of this figure shows a bundle of rods which forms one of the top capacitors of the antenna in FIG. 7. The right-hand side shows an electric equivalent consisting of a bundle of shorter rods 31 which is connected to the antenna structure through an inductance 30. Exact equivalence between the two structures exists, of course, only for one frequency, and not over a larger frequency band.

The size of the top capacitors which is required for optimum matching of the antenna to the power source, receiver, or the transmission line connected to the antenna, depends on the inductance of the cylindrical or elongated conductors. This inductance can be increased by, for instance, replacing the rods in FIG. 1 by wire coils or spirals. For instance, the cylindrical conductors 1, 2, 3, 4 in FIG. 1 can be replaced by four coaxial spirals 32, 33, 34 and 35, as shown in FIG. 11, thus requiring correspondingly smaller capacitor plates.

The invention applies not only to monopole antennas, but also to dipole antennas. The conductive ground plane (13 in FIG. 1) acts like a mirror. A monopole antenna, together with its image forms a dipole antenna. FIG. 12 shows a dipole antenna, according to this invention. This antenna is obtained by "imaging" the monopole antenna of FIG. 1. This antenna requires a balanced (symmetrical) feed line, such as a two-wire line. Similar antennas can be derived by imaging the antennas shown in FIGS. 4, 5, 8 and 9.

Dipole antennas, according to this invention, can also be derived from monopole antennas such as shown in FIGS. 1, 4, 5, 8, and 9 by replacing the ground plane 13 by a plate of approximately the same surface area as that of the top capacitor plates combined, and simultaneous doubling of the length of the cylindrical conductors. To avoid excessive excitation of the outside of the coaxial feed cable which is exposed to the fields of such antennas; cable chokes must be inserted in the feed cable; a precaution, which is standard with commonly used center-fed dipole antennas.

I claim:

1. In an antenna structure, means serving as a ground plane, a number of elongated conductors having mutual spacings which are small against operating wave length, and positioned substantially perpendicular to said ground plane; some of said conductors at their lower ends being connected to said ground plane while at least one of said conductors is connected to the input terminal of the antenna structure, inductive elements, and separate conductive segments terminating each of said elongated conductors at its upper end, to act as top capacitors against said ground plane, and interconnected by said inductive elements.

2. Structure according to claim 1, wherein said conductors are substantially of cylindrical configuration, and said conducting segments are arranged in a plane substantially parallel to said ground plane.

3. Structure according to claim 1, wherein the inductive elements are so dimensioned that the input impedance of the antenna when compared with the input impedance of an antenna of equal dimensions but with all the elongated conductors connected to the input terminal, is increased by a factor approximately equal to the square of the number of elongated conductors.

4. Structure according to claim 1, comprising a number N of substantially equal conductors, and substantially equal top capacitors arranged symmetrically around an axis substantially perpendicular to said ground plane; the interconnecting inductances being so dimensioned that the effective height of the antenna is approximately N times the physical height, and the radiation resistance approximately $N^2$ times the radiation resistance of a conventional monopole antenna having the same height.

5. Structure according to claim 4, wherein at a wavelength of the order of 60 cm, an antenna having four parallel conductors has a physical height of the order of 2.67 cm, an effective height of the order of 10.7 cm and a radiation resistance of 50 Ohm.

6. Structure according to claim 4, wherein an antenna having six parallel conductors has a physical height of the order of 1.8 cm and a radiation resistance of 50 Ohm, at 500 Mhz.

7. Structure according to claim 1, comprising non-uniform conducting segments producing an auxiliary dipole moment in a direction substantially parallel to the ground plane, causing auxiliary radiation.

8. Structure according to claim 7, comprising substantially non-uniform conductors and top capacitors having two planes of symmetry to avoid formation of a horizontal dipole moment.

9. Structure according to claim 7, comprising non-uniform conductors and non-uniform conducting segments extending within a common plane parallel to said ground plane, representing the x-y plane of a Cartesian coordinate system; said elongated conductors and conducting segments being so dimensioned that the antenna is image-symmetrical with respect to the x-z plane of said system; the symmetry condition assuring the auxiliary dipole moment in the y-direction to become substantially eliminated.

10. Structure according to claim 7, comprising elongated conductors and non-uniform conducting segments extending within a common plane parallel to the ground plane and representing the x-y plane of a Cartesian coordinate system; said elongated conductors and conducting segments being so formed as to have as a symmetry plane the y-z plane of said coordinate system; said symmetry condition assuring the auxiliary dipole moment in the x-direction to become substantially eliminated.

11. Structure according to claim 8, comprising three conductors with top capacitors connected thereto, the middle segment being relatively thin and connected to the input terminal; the two other conductors being relatively thick and connected to ground; and having top capacitor plates forming together a larger surface than the top capacitor plate of the middle conductor.

12. Structure according to claim 8, comprising two pairs of antenna segments, each pair having identical conductors and top capacitors associated therewith; one pair being interconnected at the lower ends of said conductors, and connected to the input terminal; the other pair of antenna segments being connected to the ground plane; the diameter of the latter pair of conductors being substantially larger than the diameters of the former pair of conductors; and the top capacitors of the latter pair having smaller surface areas than the top capacitors of the former pair; the inductances interconnecting the segments being substantially alike.

13. Structure according to claim 1, for the high frequency range, comprising an insulating mast and elongated conductors in the form of wires supported on said mast; some of said wires beng electrically interconnected at the base of said mast, and grounded; and at least one of said wires connected to the input terminal; the top capacitors being formed by sets of radially directed wires.

14. Structure according to claim 1, for the UHF and higher ranges, comprising top capacitors and interconnecting inductances in the form of metal films deposited on a dielectric base like a printed circuit.

15. Structure according to claim 1, comprising as top capacitors, means for producing predetermined capacities from smaller capacitor elements connected to said conductors through appropriately dimensioned inductances.

16. Structure according to claim 1, comprising as top capacitors, means for producing a predetermined capacity from a number of smaller capacitor elements connected to said conductors through appropriately dimensioned inductances; one of the top capacitors being formed of a bundle of rods, and another of said top capacitors being formed of a shorter bundle of rods connected to the antenna structure through an inductance; exact equivalence between said two bundles substantially existing for a relatively limited frequency range only.

17. Structure according to claim 1, wherein the size of the top capacitors required for optimum matching of the antenna to the input terminal, power source, receiver or transmission line, connected to the antenna, is reduced by increasing the inductance of the elongated conductors, comprising means for increasing said inductance by providing conductors in the form of coaxial spirals.

18. In an antenna structure, two sets of elongated conductors, the conductors in each set having mutual spacings which are small against operating wave length, and positioned substantially parallel to each other; one set forming an image of the other set; some of the adjacent conductor ends of the different conductor sets being connected to each other, while at least one of the conductors in each conductor set is connected to an input terminal of the antenna structure; the conductors of each conductor set forming the feed lines for a balanced two-wire input line to the antenna structure, two sets of separate conductive segments terminating each set of said elongated conductors at their other ends to act as capacitors, and inductive elements interconnecting said capacitors, to provide a desired input impedance characteristic.

* * * * *